US006910580B1

(12) United States Patent
Frankum

(10) Patent No.: US 6,910,580 B1
(45) Date of Patent: Jun. 28, 2005

(54) PORTABLE CONDIMENT CADDY

(76) Inventor: Sally May Frankum, 3221 County Rd. 890, Alvin, TX (US) 77511

( * ) Notice: Subject to any disclaimer, the term of this patent is extended or adjusted under 35 U.S.C. 154(b) by 69 days.

(21) Appl. No.: 10/368,141

(22) Filed: Feb. 18, 2003

Related U.S. Application Data

(60) Provisional application No. 60/357,668, filed on Feb. 19, 2002.

(51) Int. Cl.[7] ..... B65D 1/34
(52) U.S. Cl. ..... 206/553; 190/109; 190/127
(58) Field of Search ..... 206/553, 576, 206/579, 581; 150/112, 113; 190/109, 110, 190/127, 903

(56) References Cited

U.S. PATENT DOCUMENTS

| | | | | |
|---|---|---|---|---|
| 5,018,609 | A * | 5/1991 | Brenner | 190/110 |
| 5,105,919 | A * | 4/1992 | Bomes et al. | 190/903 |
| 5,244,268 | A | 9/1993 | Derrickson | |
| 6,109,442 | A * | 8/2000 | Roegner | 205/581 |
| 6,161,665 | A * | 12/2000 | Hoover | 190/127 |
| 6,193,034 | B1 * | 2/2001 | Fournier | 190/109 |
| 6,250,470 | B1 * | 6/2001 | Mackenzie | 206/579 |
| 6,279,707 | B1 * | 8/2001 | Godshaw et al. | 190/127 |
| 6,364,112 | B1 | 4/2002 | Pitschka | |
| 6,523,653 | B2 * | 2/2003 | Roegner | 190/109 |

* cited by examiner

*Primary Examiner*—Luan K. Bui
(74) *Attorney, Agent, or Firm*—Kenneth A. Roddy

(57) ABSTRACT

A portable soft-sided pocketed case or condiment caddy constructed particularly for containing, organizing, and transporting packets of food condiments, and other basic items such as napkins, straws and eating utensils, provides convenience and handy availability. The caddy includes a left and right panel flexibly joined together by a hinged portion and a zipper extends around three sides of the panels. A plurality of open mesh pockets and several elastic strips are attached to the interior surface of the left and right panels. The open mesh pockets are sized to accommodate small flexible condiment packets of condiments, such as catsup, mayonnaise, mustard, relish, various sauces, salad dressings, etc., of the type one receives from fast food restaurants, also salt and pepper packets, sugar or sweetener packets, and a quantity of toothpicks. The elastic strips hold additional condiment packets and one elastic strip is configured to hold knives, forks and spoons. An elongate pocket on the front cover holds straws and/or napkins. An optional transparent zippered money pocket on the front cover accommodates paper currency, coins, car keys, and other loose items. An elongate transparent zippered cargo pocket on the exterior of the right panel accommodates miscellaneous larger items.

4 Claims, 6 Drawing Sheets

PORTABLE CONDIMENT CADDY

CROSS REFERENCE TO RELATED APPLICATION

This application claims priority of U.S. Provisional Application Ser. No. 60/357,668, filed Feb. 19, 2002.

BACKGROUND OF THE INVENTION

1. Field of the Invention

This invention relates generally to containers for food products, and more particularly to a portable soft-sided pocketed case for containing, organizing, and transporting packets of food condiments, and other basic items such as napkins, straws and eating utensils.

2. Brief Description of the Prior Art

When one purchases food products such as hamburgers, hotdogs, French fries, onion rings, and other sandwiches and foodstuffs, at a fast food restaurant, small flexible packets of condiments, such as catsup, mayonnaise, mustard, relish, various sauces, salad dressings, etc., and small packets of salt and pepper are usually placed in the bag with the related food products. Often after leaving the restaurant, one discovers that the condiment packets or salt and pepper packets were not included, that they were not the kind requested, or that there is an insufficient amount. Eating utensils are also often accidentally left out, or they become easily broken before or during use. Some people prefer condiments of a brand that is different from the brand issued by the particular fast food establishment.

Because these problems are so common, many people keep a number of small condiment packets and basic related items such as salt and pepper packets, napkins, straws and plastic utensils in their automobile glove compartments, desk drawers, purses, or briefcases. However, the inventor is not aware of any convenient means for efficiently containing, organizing, and transporting these small condiment packets and basic items for convenience and handy availability.

Soft-sided lunch boxes and ice chests are known in the art, however they are designed primarily for containing and transporting sandwiches and beverages, and not particularly suited for containing, organizing, and transporting a number of small condiment packets and basic related items. Picnic baskets, and camping kits for kitchen articles are also known in the art, however they are designed primarily for containing and transporting sandwiches, bottles, cans, dishes and other items and, consequently, they are big and bulky, and not particularly suited for containing, organizing, and transporting a number of small condiment packets and basic related items.

Pitschka, U.S. Pat. No. 6,364,112 discloses a condiment container that attaches to other objects. In one embodiment of the invention, the condiment container is a portable and disposable container that adhesively attaches to the interior of a vehicle and includes a container body that holds the condiment. The container includes an attaching arm that rotatably couples to the container body, and has an adhesive material on one of its sides. A consumer can attach the container to a surface in a vehicle by rotating the arm away from the container body and abutting the adhesive side of the arm to the vehicle surface.

Derrickson, U.S. Pat. No. 5,244,268 discloses a case for carrying condiments, spices and other food items in an airtight and moisture proof environment. The case has slotted compartments in which resealable pouches are provided. The pouches are detachably fastened to the sides of these compartments. Various condiments, spices or other food items can be easily transported in the case for later use.

The present invention is distinguished over the prior art in general, and these patents in particular by a portable soft-sided condiment caddy constructed particularly for containing, organizing, and transporting packets of food condiments, and other basic items such as napkins, straws and eating utensils, to provide convenience and handy availability. The caddy includes a left and right panel flexibly joined together by a hinged portion and a zipper extends around three sides of the panels. A plurality of open mesh pockets and several elastic strips are attached to the interior surface of the left and right panels. The open mesh pockets are sized to accommodate small flexible condiment packets of condiments, such as catsup, mayonnaise, mustard, relish, various sauces, salad dressings, etc., of the type one receives from fast food restaurants, also salt and pepper packets, sugar or sweetener packets, and a quantity of toothpicks. The elastic strips hold additional condiment packets and one elastic strip is configured to hold knives, forks and spoons. An elongate pocket on the front cover holds straws and/or napkins. An optional transparent zippered money pocket on the front cover accommodates paper currency, coins, car keys, and other loose items. An elongate transparent zippered cargo pocket on the exterior of the right panel accommodates miscellaneous larger items.

SUMMARY OF THE INVENTION

It is therefore an object of the present invention to provide a portable soft-sided condiment caddy for efficiently containing, organizing, and transporting small flexible condiment packets of condiments, such as catsup, mayonnaise, mustard, relish, various sauces, salad dressings, etc., of the type one receives from fast food restaurants, also salt and pepper packets, sugar or sweetener packets, toothpicks and other items such as napkins, straws and eating utensils.

It is another object of this invention to provide a portable soft-sided condiment caddy that will hold a number of condiment packets and related basic items for convenience and handy availability.

Another object of this invention is to provide a portable soft-sided condiment caddy that allows the user to easily organize his or her supply of condiments and related items by placing particular types of the condiments and related items in selected pockets and elastic strips.

Another object of this invention is to provide a portable soft-sided condiment caddy that allows the type and quantity of condiments and related items contained therein to be easily seen and identified.

A further object of this invention is to provide a portable soft-sided condiment caddy that is compact in size and can be stored in a small space.

A still further object of this invention is to provide a portable soft-sided condiment caddy that is attractive in appearance, inexpensive to manufacture, and durable in use.

Other objects of the invention will become apparent from time to time throughout the specification as hereinafter related.

The above noted objects and other objects of the invention are accomplished by a portable soft-sided pocketed condiment caddy constructed particularly for containing, organizing, and transporting packets of food condiments, and other basic items such as napkins, straws and eating utensils, provides convenience and handy availability. The caddy includes a left and right panel flexibly joined together by a hinged portion and a zipper extends around three sides of the panels. A plurality of open mesh pockets and several elastic strips are attached to the interior surface of the left and right panels. The open mesh pockets are sized to accommodate small flexible condiment packets of condiments, such as catsup, mayonnaise, mustard, relish, various sauces, salad dressings, etc., of the type one receives from fast food restaurants, also salt and pepper packets, sugar or sweetener packets, and a quantity of toothpicks. The elastic strips hold additional condiment packets and one elastic strip is configured to hold knives, forks and spoons. An elongate pocket on the front cover holds straws and/or napkins. An optional transparent zippered money pocket on the front cover accommodates paper currency, coins, car keys, and other loose items. An elongate transparent zippered cargo pocket on the exterior of the right panel accommodates miscellaneous larger items.

DESCRIPTION OF THE PREFERRED EMBODIMENT

Figure 1:
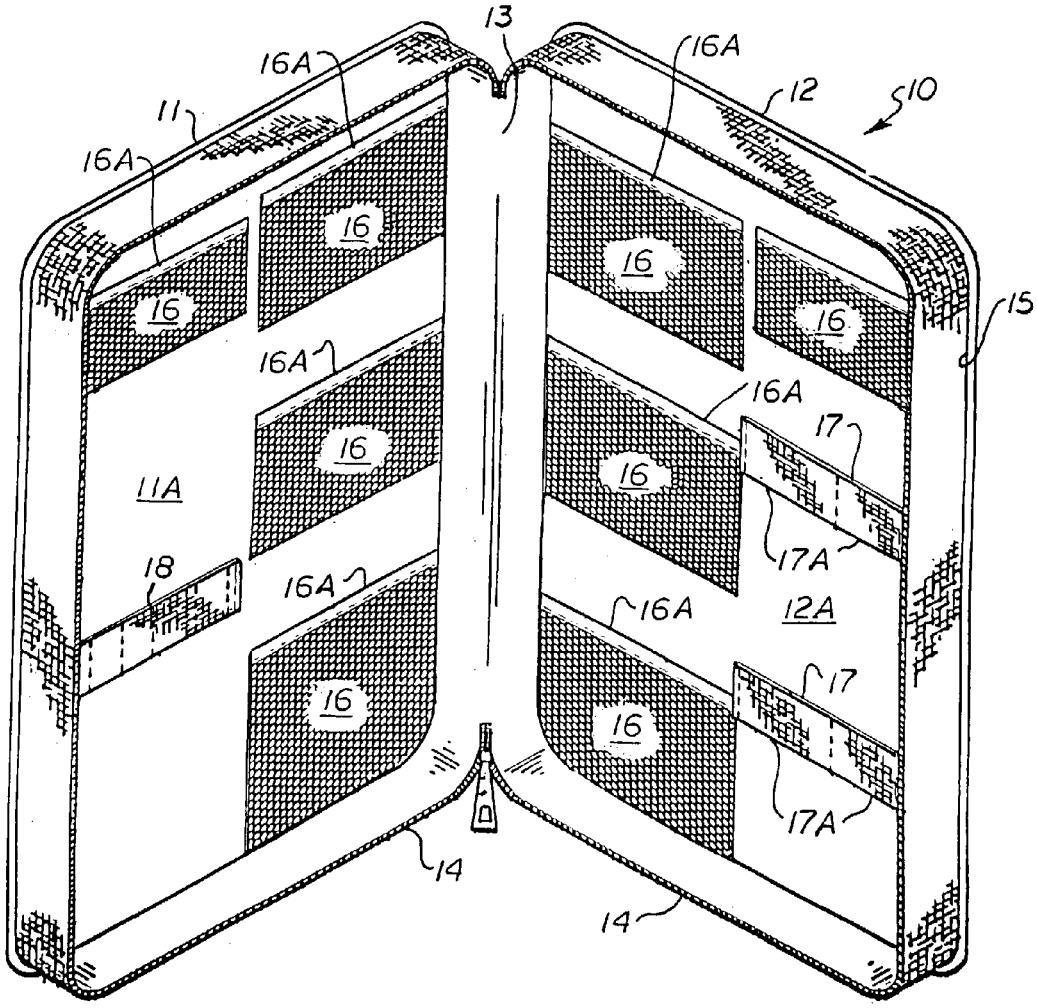
FIG. 1 is a perspective view of the condiment caddy in accordance with a preferred embodiment, shown in the open position.
Figure 7:
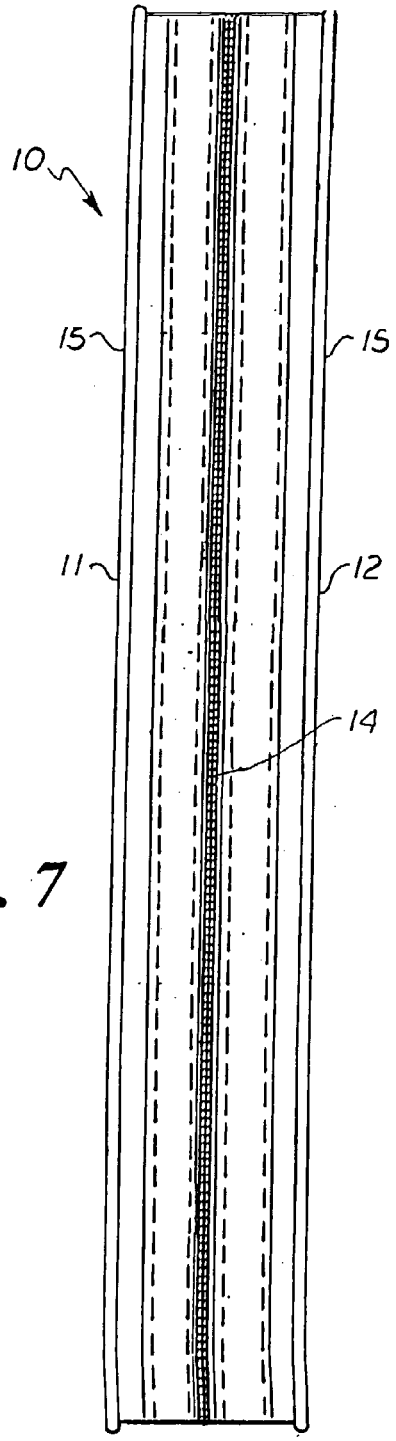
FIG. 7 is a side elevation view of the unhinged side of the condiment caddy, shown in a closed position.
Figure 6:
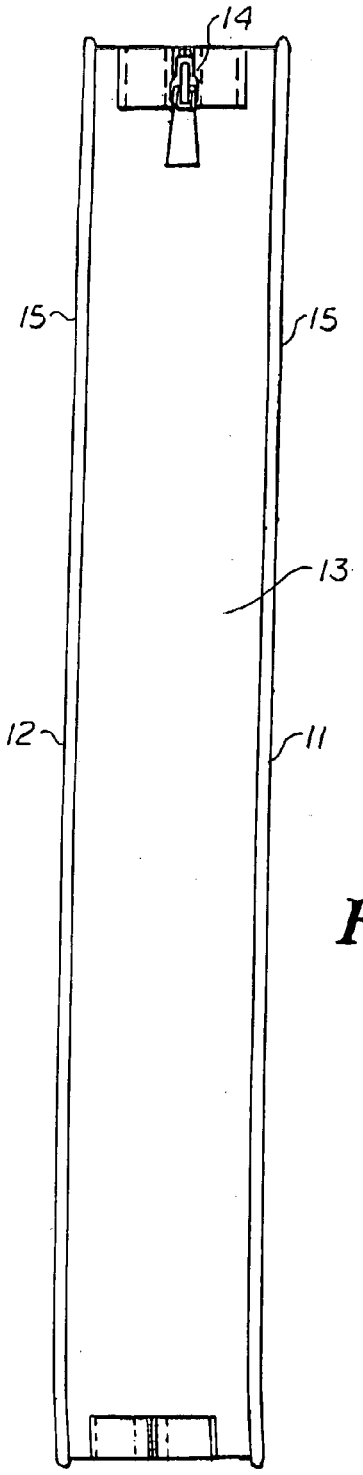
FIG. 6 is a side elevation view of the hinged side of the condiment caddy.

Referring to the drawings by numerals of reference, there is shown in FIG. 1, a condiment caddy 10 in accordance with a preferred embodiment of the invention, illustrated in the open position. The condiment caddy 10 is a soft-sided carrying case that includes a left panel 11 and a right panel 12, which are flexibly joined together by a hinged portion 13 which may or may not include a reinforcement spine. Referring additionally to FIGS. 6 and 7, in the preferred embodiment, a zipper 14 extends from the hinged portion 13 around three sides of the left and right panels 11 and 12, such that when unzipped the side panels may be opened and, when zipped closed, the panels form an enclosed central compartment. In the preferred embodiment, the condiment caddy is approximately 11" in length, 6¾" wide and 1½" thick, in its closed condition.

It should be understood that the zipper 14 may be a two-way zipper having two pull slides that can be opened from either end, or may be replaced with other suitable fastening means such as Velcro® strips, snap fasteners, or the like, which would substantially enclose the central compartment.

The left and right panels 11 and 12 are constructed of well-known suitable flexible fabric or synthetic materials, and may also include conventional stiffening materials that are covered with a fabric or synthetic material. In a preferred embodiment, the panels are constructed of nylon. Piping 15 may also be attached to the periphery of the left and right panels 11 and 12 by sewing or other conventional means.

Figure 2:
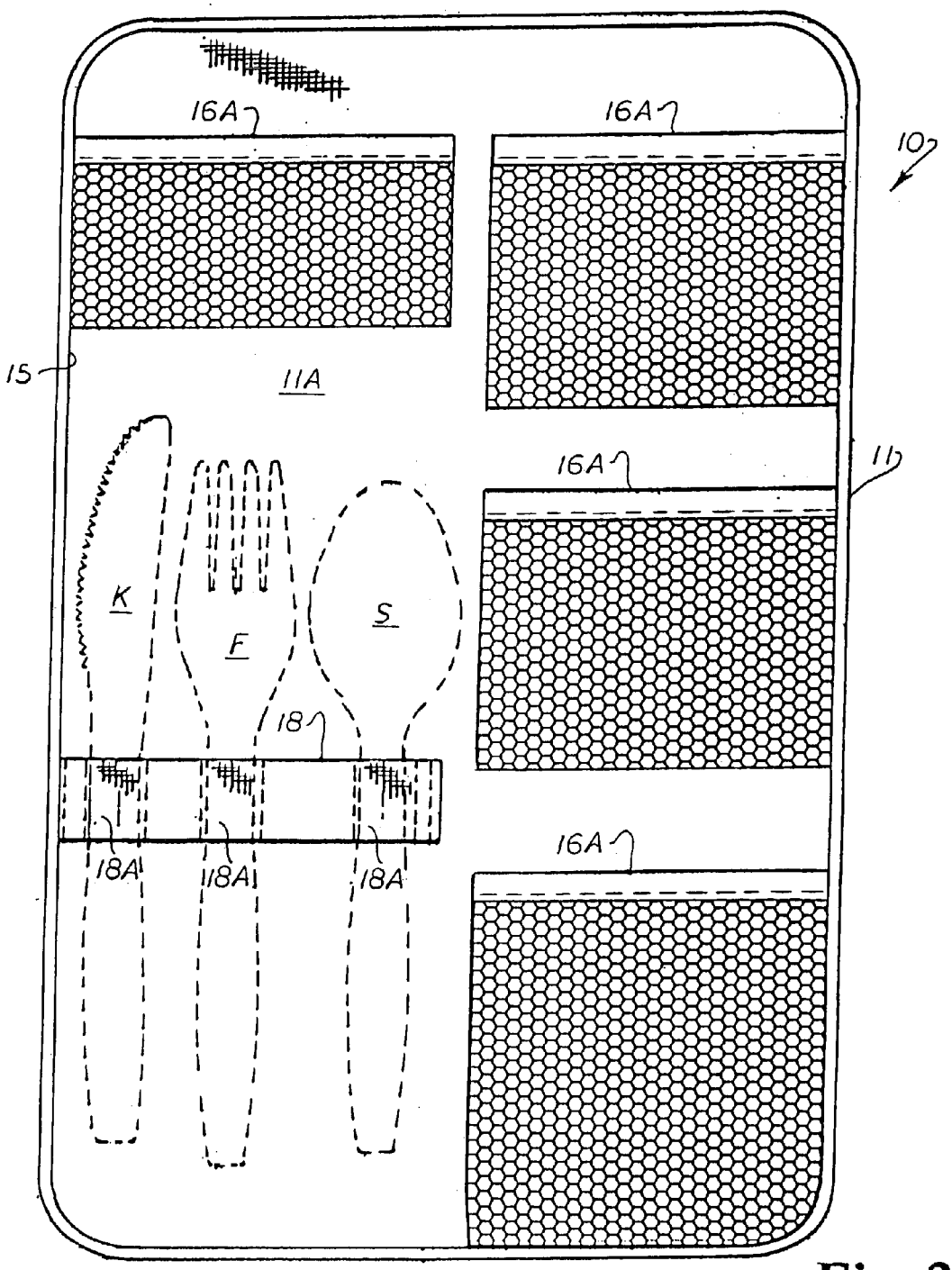
FIG. 2 is an elevation view of the inside left-hand panel of the condiment caddy.
Figure 3:
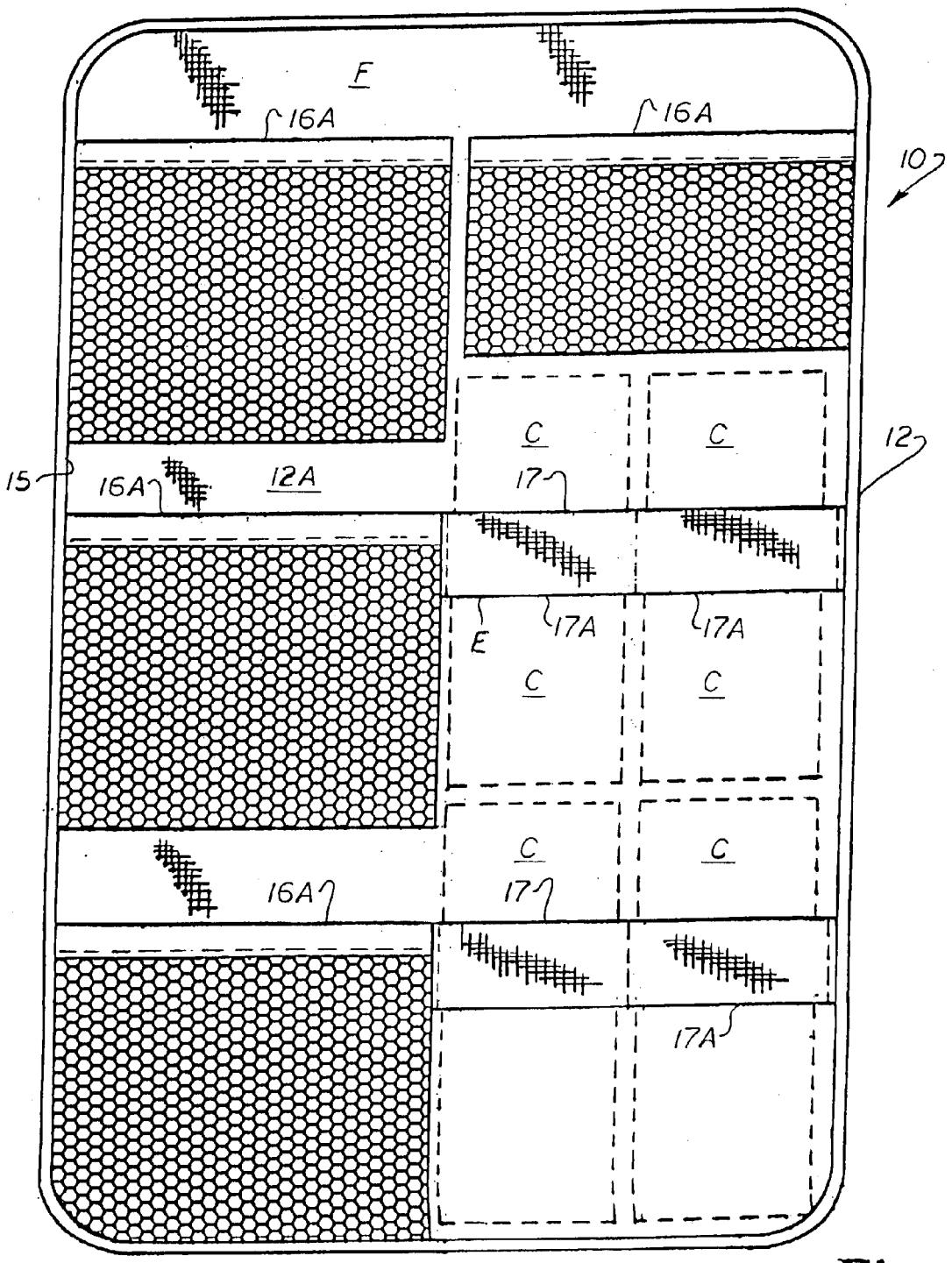
FIG. 3 is an elevation view of the inside right-hand panel of the condiment caddy.

As best seen in FIGS. 2 and 3, the left panel 11 and right panel 12 each have an interior surface 11A and 12A, respectively. A plurality of pockets 16 are permanently attached to the interior surfaces 11A and 12A of the left and right panels 11 and 12 by sewing or other conventional means. Each of the pockets 16 consists of a generally rectangular piece of open mesh material, preferably nylon netting, that is permanently attached to the interior surfaces of the panels along its side and bottom edges, and has an elastic strip 16A sewn across its open top edge that allows items to be placed into the pockets. The openings in the mesh material are of sufficient size to allow the contents to be easily seen and identified, and the elastic strip 16A prevents accidental removal of the contents from the pocket.

A pair of elastic strips 17 are permanently attached to the interior surface 12A of the right panel 12 and each is secured thereon by sewing or other conventional means, so as to form two laterally adjacent expandable loops 17A sized to receive additional flexible condiment packets C, as indicated in dashed line. The elastic loops 17A grip the condiment packets C at their midsection and the elastic strips 17 are spaced vertically relative to one another such that the ends of the condiment packets held in their loops will not interfere with one another.

An elastic strip 18 is permanently attached to the interior surface 11A of the left panel 11 and is secured thereon by sewing or other conventional means, so as to form three laterally adjacent expandable loops 18A sized to receive the handle portions of eating utensils, such as a knife K, a fork F and a spoon S, as indicated in dashed line. The elastic loops 18A are sufficiently taught so as to resiliently grip the handle portions and prevent them from accidentally falling out.

Small flexible packets of condiments, such as catsup, mayonnaise, mustard, relish, various sauces, salad dressings, etc., of the type one receives from fast food restaurants, are generally of several standard, generally rectangular sizes. For example, most condiment packets are approximately 1⅜" wide and from about 1¾" to 3⅝" length, and about 3/16" to ¼" thick. Rectangular salt and pepper packet from about ¾" to 1¼" wide, 1½" to 1⅞ and artificial sweetener packets are generally about 1½" wide, 2½" about 1/16" to ⅛" thick. In the preferred embodiment, the sever accommodate the flexible condiment packets, salt and pepper packets, and sugar or sweetener packets, of the aforementioned sizes, and at least one pocket is of sufficient width to accommodate a quantity of toothpicks.

Thus, the user can easily organize his or her supply of condiments and related items by placing particular types of the condiments and related items in selected pockets. For example, one pocket may contain flexible condiment packets of catsup, another may contain mayonnaise, another may contain mustard, etc. Other pockets may contain salt and/or pepper packets, sugar or sweetener packets, or a quantity of toothpicks, etc.

Additional condiment packets C may also be placed in the loops 17A of the elastic strips 17 and eating utensils such knives K, forks F and spoons S may be placed in the loops 18A of the elastic strips 18. The type and quantity of the items contained in the pockets 16 and the elastic strips 17, 18 can be easily seen and identified.

Figure 4:
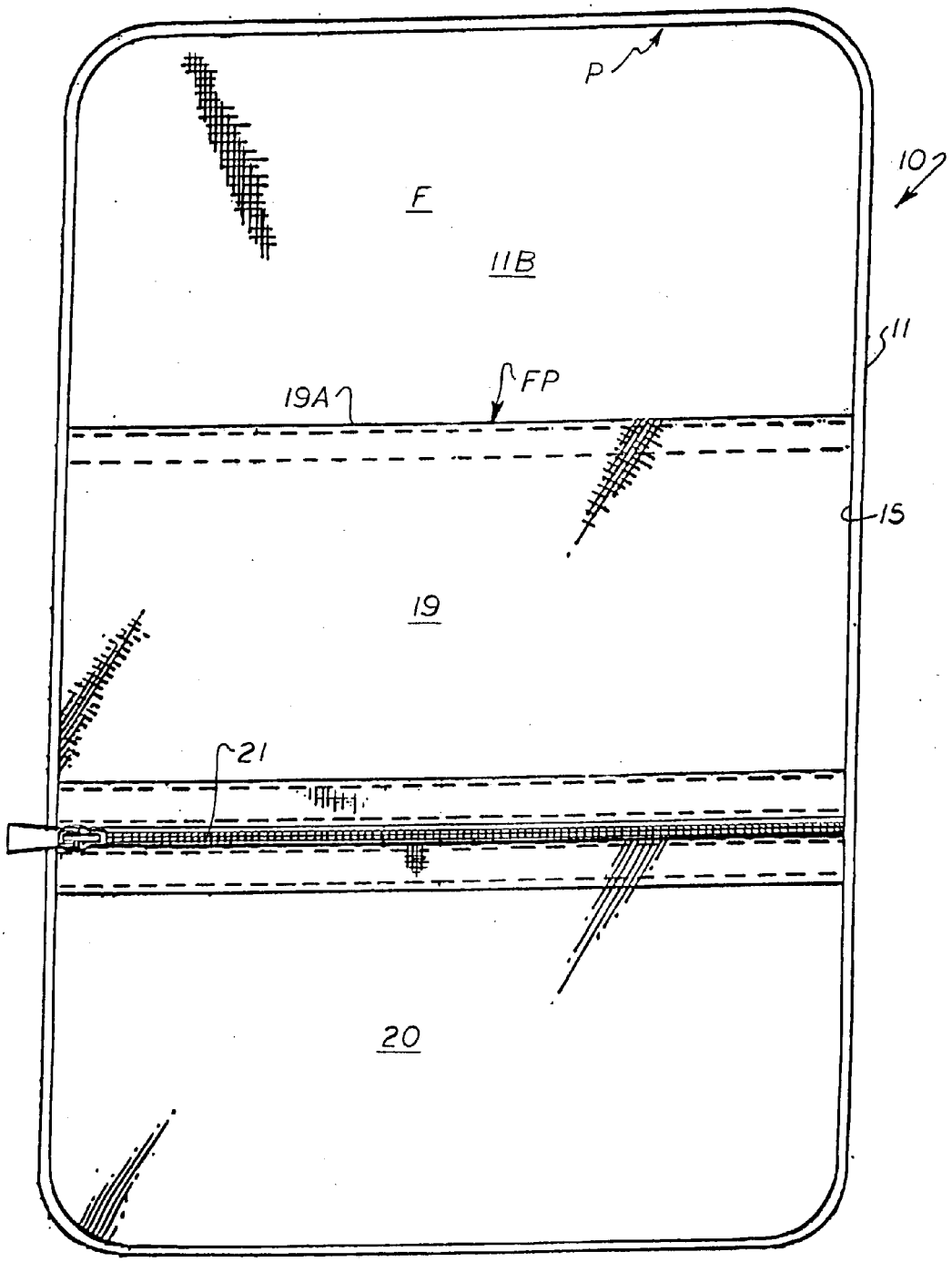
FIG. 4 is an elevation view of the outside front panel of the condiment caddy.

Referring now to FIG. 4, the left panel 11 has an exterior surface 11B, which forms the front outer cover of the condiment caddy 10. An elongate rectangular pocket 19 formed of a piece of suitable flexible fabric or synthetic material is permanently attached along its lateral and bottom edges to the exterior surface 11B of the left panel 11 by sewing or other conventional means, leaving an open top edge 19A that allows elongate items, such as straws and/or napkins to be placed into the pocket. In a preferred embodiment, the elongate rectangular pocket 19 has a vertical length approximately two-thirds the vertical length of the exterior surface of the left panel 11.

Optionally, a second rectangular pocket 20 may be permanently attached along its lateral and top and bottom edges to the exterior of the pocket 19 described above by sewing or other conventional means. A zipper 21 extends across the upper portion of the pocket 20 from side to side, such that when unzipped the pocket may be opened to insert or remove items, and when zipped closed, the pocket forms an enclosed compartment. It should be understood that the zipper 21 may be replaced with other suitable fastening means such as Velcro® strips, snap fasteners, or the like. The pocket 20 may be used as a money pocket for storing paper currency and coins, car keys, and other loose items. In the preferred embodiment, the pocket 20 is formed of transparent material so that the contents may be easily seen and identified. In a preferred embodiment, the pocket 20 has a vertical length of approximately one-half the vertical length of the exterior surface of the elongate rectangular pocket 19.

Figure 5:
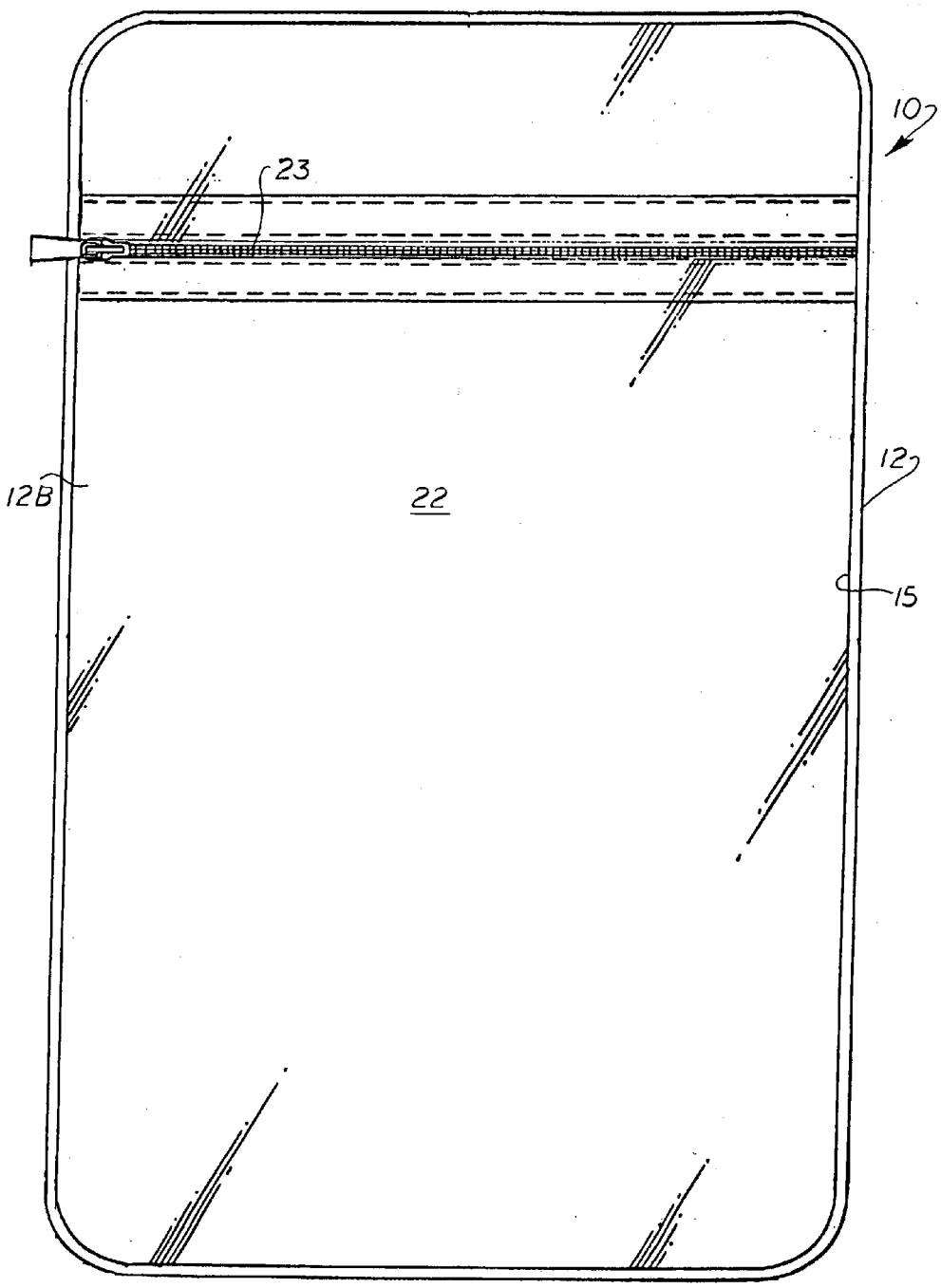
FIG. 5 is an elevation view of the outside back panel of the condiment caddy.

Referring now to FIG. 5, the right panel 12 has an exterior surface 12B, which forms the back outer cover of the condiment caddy 10. An elongate rectangular pocket 22 formed of a piece of suitable flexible transparent material is permanently attached along its lateral and top and bottom edges to the exterior 12B of the right panel 12 by sewing or other conventional means. A zipper 23 extends across the pocket 22 from side to side near its top end, such that when unzipped the pocket may be opened to insert or remove items, and when zipped closed, the pocket forms an enclosed compartment. It should be understood that the zipper 23 may be replaced with other suitable fastening means such as Velcro® strips, snap fasteners, or the like. The pocket 22 may be used as a cargo pocket for storing and transporting miscellaneous larger items. The transparent cargo pocket allows the contents to be easily seen and identified.

While this invention has been described fully and completely with special emphasis upon a preferred embodiment, it should be understood that within the scope of the claims the invention may be practiced otherwise than as specifically described herein.

What is claimed is:

1. A portable soft-sided condiment case for containing, organizing and transporting small packets of food condiments, eating utensils, and accessory items for convenient availability and access, comprising:

a first and a second generally rectangular side panel, each having a transverse top and bottom end, an interior surface and an exterior surface, and longitudinal lateral sides, said first and second side panels hingedly joined together along one of said longitudinal lateral sides, respectively, by a hinged portion;

said hinged portion formed of flexible fabric material and each of said first and second side panels formed of two plies of said flexible fabric material enclosing a generally rectangular blank of stiffening material;

zipper means extending along said transverse top and bottom end and unhinged longitudinal lateral sides of each said first and second side panels, which in an unzipped condition allows said first and second side panels to be opened to a laterally adjacent relation, and in a zipped condition secures said first and second side panels together in superposed relation to form an enclosed central compartment;

a plurality of generally rectangular inner pockets on said interior surface of each of said first and second side panels, each of said inner pockets having an open top end and secured on said interior surface along lateral side edges and a bottom edge, and having an elastic strip secured across a top edge of said open top end;

each of said inner pockets sized to accommodate a plurality of small rectangular flexible condiment packets of viscous material, salt and pepper packets, and sugar or sweetener packets;

each of said inner pockets of formed of a generally open mesh netting material having openings of sufficient size to allow the packets contained therein to be easily seen and identified, and said elastic strip being sufficiently taught to prevent accidental removal thereof;

an elastic strip secured to said interior surface of said first panel to form three laterally adjacent expandable loops, each of said expandable loops being sufficiently taught and sized to resiliently grip a handle portion of a knife, fork or spoon;

a pair of elastic strips secured to said interior surface of said second panel to form two laterally adjacent expandable loops in each, respectively, to receive additional small rectangular flexible condiment packets of viscous material, each of said expandable loops being sufficiently taught and sized to resiliently grip at least one of said packets of viscous material at its midsection;

a first elongate rectangular outer pocket formed of flexible fabric material secured on said exterior surface of said first panel along lateral side edges and a bottom edge, and having a vertical length approximately two-thirds the vertical length of said exterior surface of said first panel and an open top end for accommodating straws and napkins;

a shorter rectangular outer pocket formed of flexible material secured on an exterior lower portion of said elongate rectangular outer pocket along lateral side edges and a bottom edge, and having a vertical length of approximately one-half the vertical length of said elongate rectangular outer pocket, said shorter rectangular outer pocket having a top end with zipper means along said top end, which in a zipped condition forms an enclosed compartment for storing paper currency and coins, car keys, and other loose items; and a second elongate rectangular pocket formed of flexible fabric material secured on said exterior surface of said second panel along lateral side edges and a bottom edge and occupying substantially the entire area of said exterior surface of said first panel, said second elongate rectangular outer pocket having a top end with zipper means along said top end, which in a fastened condition forms an enclosed compartment for storing loose items.

2. The portable soft-sided condiment case according to claim 1, wherein said shorter rectangular outer pocket is formed of transparent material to allow the contents thereof to be easily seen and identified.

3. The portable soft-sided condiment case according to claim 1, wherein said shorter rectangular outer pocket is formed of transparent material to allow the contents thereof to be easily seen and identified.

4. The portable soft-sided condiment case according to claim 1, wherein at least one of said inner pockets is sized to accommodate a quantity of toothpicks.

* * * * *